United States Patent [19]

Lang et al.

[11] Patent Number: 4,898,629

[45] Date of Patent: Feb. 6, 1990

[54] METHOD OF PRODUCING HOT ROLLED STEEL STRIP

[75] Inventors: Cestmir Lang, Oberhausen; Lutz Meyer, Voerde, both of Fed. Rep. of Germany

[73] Assignee: Thyssen Stahl AG, Duisburg, Fed. Rep. of Germany

[21] Appl. No.: 209,256

[22] Filed: Jun. 20, 1988

[30] Foreign Application Priority Data

Jul. 1, 1987 [DE] Fed. Rep. of Germany ..... 3721641

[51] Int. Cl.[4] ..... C21D 8/02

[52] U.S. Cl. ..... 148/12 B; 148/12 F

[58] Field of Search ..... 148/12 F, 12 R, 12 B, 148/333, 334, 335, 336

[56] References Cited

U.S. PATENT DOCUMENTS

| | | | |
|---|---|---|---|
| 4,397,697 | 8/1983 | Freier et al. | 148/12 F |
| 4,702,778 | 10/1987 | Takahashi et al. | 148/12 F |

FOREIGN PATENT DOCUMENTS

| | | | |
|---|---|---|---|
| 0099520 | 2/1984 | European Pat. Off. . | |
| 53-129117 | 11/1978 | Japan | 148/12 F |
| 54-58619 | 5/1979 | Japan | 148/12 F |
| 2139247 | 11/1984 | United Kingdom . | |

OTHER PUBLICATIONS

Patent Abstracts of Japan, Band 9, Nr. 211 (C-300) [1934], 29 Aug. 1985; & JP-A-60 77 921 (Shin Nippon Seitetsu K.K.) 02-05-1985.

Stahl und Eisen, Band 89, Nr. 15,24. Jul. 1979, pp. 815-824; H. W. Grasshoff: "Erfahrungen bei der Herstellung von Warm-und Kaltband aus Kohlenstroffreichen Stahlen mit Sorbitischen Gefugeanteilen", p. 819, Linke Spalte, Zeilen 34-46.

Patent Abstracts of Japan, Band 10, Nr. 214 (C-362) [2270], 25 Jul. 1986; & JP-A-61 52 317 (Kobe Steel Ltd) 15-03-1986.

*Primary Examiner*—Deborah Yee

*Attorney, Agent, or Firm*—Sprung Horn Kramer & Woods

[57] ABSTRACT

The invention relates to a method of producing hot rolled strip having tensile strength values of Rm=500 to 780 N/mm$^2$ from unalloyed or low-alloy steels with 0.3 to 0.9% C. A steel slab is austenitized and rolled into hot rolled strip which is cooled on a run-out table and then coiled.

The characterizing feature of the invention is that the hot rolling and the cooling of the strip on the run-out table are performed in such a manner that the austenite/ferrite transformation in the hot rolled strip starts only in the coil and is finished in the coil.

9 Claims, No Drawings

METHOD OF PRODUCING HOT ROLLED STEEL STRIP

BACKGROUND OF THE INVENTION

The invention relates to a method of producing hot strip from unalloyed or low-alloy steels with carbon contents in the range of 0.3–0.9% by the following steps:

austenitization of a slab,
hot rolling of the heated slab,
cooling of the strip and
coiling of the strip.

Hot strip from such steels is used for direct further processing by working or for the production of cold rolled strip. The finished parts made of these steels are normally subjected to a heat treatment by hardening and annealing to adjust the required strength and hardness values.

Due to the carbon contents, hot strip made from these steels has high tensile strength. It depends on the proportion of pearlite in the structure and on the formation of pearlite. In the case of steels having carbon contents between 0.4 and 0.7%, an increase in the proportion of pearlite in the structure from 50–100% produces an increase in tensile strength from 600 to 1100 N/mm$^2$ (Journal of the Iron and Steel Institute, 205, 1967, Page 653/664). The proportion of pearlite in the structure can be increased while at the same time the quantity of ferrite is reduced, if the cooling rate of the strip is high in the zone of the austenite/ferrite transformation. Furthermore, the cooling rate in the zone of the austenite/ferrite transformation affects the lamellar distance of pearlite and therefore also affects strength. In the case of a steel with 0.72% C and 0.73% Mn, an increase in the cooling rate from 5 to 30 K./sec reduces the lamellar distance of pearlite and thereby increases the tensile strength from 950 to 1300 N/mm$^2$ ("Atlas of the Heat Treatment of Steels", published by Stahl-Eisen, Duesseldorf, 1961, Table II-101 E and Mem. Sci. Revue de Metallurgie 75, 1978, pages 149/159).

In practice, when hot strip is produced from steels having relatively high carbon contents, the hot strip is heavily cooled by water on the run-out roller table of the hot strip mill. The object of this method is to equalize mechanical properties and structure over the length of the hot strip ("Stahl and Eisen", 89, 1969, pages 815/824). As already described, the high cooling rate due to the heavy water cooling increases the proportion of pearlite and reduces that of ferrite, while reducing the lamellar distance of the pearlite. As already explained, both changes cause an increase in the strength of the hot strip.

With this method of production, the following typical properties of hot strip are obtained for two steels according to DIN 17200 and DIN 17220:

| Steel | Tensile Strength | Hardness |
|---|---|---|
| C 45 | ≧800 N/mm$^2$ | ≧95 HRB |
| C 75 | ≧1000 N/mm$^2$ | ≧25 HRC |

The mean lamellar distance of pearlite is between 0.1 and 0.2 μm.

For the direct further working of hot strip thus produced, by bending, adjusting, coiling or punching, or for the production of cold rolled strip, the high strengths result in high forming forces and throw a heavy load on installations. The result is both high energy costs and a shortened service life of installations.

Methods are known (European Patent Specifications 0 019 193 and 0 099 520) in which the incorporation of an additional device on the run-out roller table of the hot strip mill partially reduces the cooling rate in the austenite/ferrite transformation, namely by coiling of the hot rolled strip in an incubator. In both, the prior art processes the time of exposure of the strip in the incubator is less than 2 minutes. Then the strip is uncoiled and cooled and coiled in a conventional coiling installation. The object of reducing cooling rate by coiling in the incubator is to encourage ferrite formation, thereby increasing the proportion of ferrite in the structure. However, the steels mentioned in these two Specifications have low carbon contents, and their structures consist mainly of ferrite. In contrast, the main object of the method according to the invention is to reduce tensile strength by increasing the lamellar distance of pearlite—i.e., that structural component representing more than half the formation of the structure in the case of the pearlitic-ferritic steels in question.

It is an object of the invention to reduce the tensile strength of hot strip of unalloyed or low-alloy steel with 0.3–0.9% C, without affecting the uniformity of its properties or the structural formation over the length and width of the hot strip.

SUMMARY OF THE INVENTION

According to the invention the hot rolling and cooling of the hot strip on the run-out roller table are so controlled that the austenite/ferrite transformation in the hot strip starts only in the coil and is finished in the coil.

The method according to the invention makes use of the fact that pearlitic-ferritic steels have a low temperature during cooling at the start of the austenite/ferrite transformation and that an increase in temperature occurs during the transformation to the pearlite stage. The method according to the invention is performed by austenite/ferrite transformation in the hot strip, which hitherto took place on the run-out roller table of the hot strip mill, is displaced to the coil. As regards structural formation, the method coarsens the pearlitic structure. At 0.3 μm and higher the lamellar distance of pearlite is about twice as high as in the structure of fine lamellar pearlite. At the same time the proportion of ferrite in the structure is increased and therefore the proportion of pearlite reduced. These two changes in structure contribute towards reducing the strength of the hot strip.

For example, the tensile strength values of hot strip from the aforedescribed steels C 45 and C 75 are reduced when the method according to the invention is used to a maximum of Rm=650 and Rm=750 N/mm$^2$ respectively. This produces a reduction in strength of 150 and 250 N/mm$^2$ or more respectively in comparison with steels produced by prior art methods.

The satisfactory uniformity of properties and structural formation in the method according to the invention is assisted by the aforementioned phenomenon that steels with a relatively high carbon content evolve heat heavily during transformation to the pearlite stage. For example, in the case of a steel having about 0.35% C heating amounts to 20 to 30 K., this figure being 40 to 60 K. in the case of a steel with about 0.8% C. In the method according to the invention the production steps are so performed that the austenite/ferrite transformation in the hot strip only starts in the coil and is finished in the coil. The evolution of heat in the coil equalizes the temperature of the strip above the outer and inner windings of the coil, while at the same time reducing the cooling rate in the zone of the austenite/ferrite transformation, with the aforedescribed consequences for the reduced strength of the hot strip.

In the prior art method of the heat evolved during the austenite/ferrite transformation was removed by connecting further water cooling systems to the run-out roller table. However, the control circuit of the cooling system reacts with a delay to each coil temperature measured. This means that during the transformation the evolution of heat causes fluctuations in the cooling rate of the hot strip, which led to local fluctuations in the structural formation and the properties over strip length, in dependence on the speed of cooling water control. Since the austenite/ferrite transformation takes place only in the coil, such fluctuations are precluded when low-strength hot strip is produced by the method according to the invention. It is therefore an essential feature of the method according to the invention that complete austenite/ferrite transformation reliably takes place in the coil. If, in contrast, the austenite/ferrite transformation takes place partly on the run-out roller table and partly in the coil, the uniformity of properties and structural formation will be adversely affected. The winding condition of the strip is also negatively affected by an undefined course of austenite/ferrite transformation over strip length.

A low tensile strength of 500 to 780 N/mm$^2$ and a coarse lamellar pearlite formation (mean lamellar distance of pearlite larger than 0.3 $\mu$m) in hot strip is achieved according to the invention if the cooling speed in the zone of the austenite/ferrite transformation is reduced from the previously approximately 4–40 K./sec to 0.05 K./sec or less.

To adjust such a low cooling speed, the invention proposes that the following conditions shall be maintained, in dependence on the carbon content:

the final rolling temperature in hot rolling is 860° C. or higher, a rolling velocity of at least 7 m/sec is adjusted in the last finishing stand, and the coiling temperature is maintained at 640° C. or higher by slight water cooling.

with a carbon content in the range of 0.33 to 0.49% in the hot strip, to adjust a maximum tensile strength of 650 N/mm$^2$ the final rolling temperature in hot rolling is 860° C. or higher, a rolling velocity of at least 8 m/sec is adjusted in the last finishing stand, and the coiling temperature is maintained at 680° C. or higher.

with a carbon content in the range of 0.50 to 0.65% in the hot strip, to adjust a maximum tensile strength of 730 N/mm$^2$ the final rolling temperature in hot rolling is 860° C. or higher, a rolling velocity of at least 7.5 m/sec is adjusted in the last finishing stand, and the coiling temperature is maintained at 660° C. or higher.

with a carbon content in the range of 0.66 to 0.90% in the hot strip, to adjust a maximum tensile strength of 780 N/mm$^2$ the final rolling temperature in hot rolling is 860° C. or higher, a rolling velocity of at least 7 m/sec is adjusted in the last finishing stand, and the coiling temperature is maintained at 640° C. or higher.

The stated parameters are particularly suitable for hot strip thicknesses of 2–3 mm and run-out lengths between 100 and 150 m, to ensure that the austenite/ferrite transformation takes place completely in the coil.

The method can be used for steels which are produced from

| | |
|---|---|
| 0.32–0.9% | C |
| 0.20–1.5% | Mn |
| up to 2.0% | Si |
| up to 0.05% | P |
| up to 0.05% | S |
| up to 0.02% | N |
| up to 0.15% | Al |

remainder iron and unavoidable impurities.

The steel can also be alloyed with

| | |
|---|---|
| up to 3.5% | Cr |
| up to 3.5% | Ni |
| up to 0.5% | Mo |
| up to 0.20% | V |
| up to 0.03% | Ti |
| up to 0.15% | Zr |
| up to 0.005% | Te |
| up to 0.01% | B. |

These alloying elements increase hardenability (Cr, Ni, Mo, V, B), bind nitrogen (Ti, Zr) or influence the form of sulphides (Zr, Te).

The invention will now be described in greater detail with reference to embodiments thereof. The method according to the invention will also be compared with manufacturing conditions not covered by the invention.

EXAMPLES

The steels A to Z listed in Table 1 were melted by the oxygen top blowing process. They are therefore unalloyed and low-alloyed steels for hardening and tempering according to DIN 17200 and 17222. Table 2 lists the production parameters and the values of the mechanical properties and pearlite formation.

The steels A, B, D, E, J. M, Q, R, X, Y are covered by the invention. The steels C, H, I, O, P, T, U, V and Z, which have undergone a transformation on the run-out roller table and also the steels F, G, K, L, N and S, in which the transformation took place partly on the run-out roller table and partly in the coil, are not covered by the invention.

The values listed in Table 2 show clearly that the steels covered by the invention have substantially lower values of tensile strength and hardness. The differences in strength as between steels produced by the prior art and by the method according to the invention become greater with increasing carbon content.

Another important criterion of the method according to the invention is the lamellar distance of the pearlitic structure. The steels produced by the process according to the invention have a mean lamellar distance greater than 0.3 $\mu$m, while the steels with fine lamellar pearlite have a mean lamellar distance smaller than 0.2 $\mu$m.

The example of steels R and S shows particularly clearly that complete austenite/ferrite transformation of the coil is important. Although the coil temperature of steel S, which is not covered by the invention, is 680° C. and therefore higher than that of steel R according to the invention with 665° C., the tensile strength of steel S is clearly higher than that of steel R. Due to the higher cooling rate of 15 K./sec, in the case of steel S the austenite/ferrite transformation partly took place on the run-out roller table the heat evolved during transformation contributing towards increasing the coil temperature. In contrast, in the case of steel R according to the invention the austenite/ferrite transformation took place completely in the coil. The increase in temperature occurring during pearlitic transformation led to a equalization of the temperature in both the outer and inner windings of the coil and at the same time to a reduction in the cooling rate to 0.01 K./sec, the consequence being a reduction in the strength of the strip.

Due to their reduced strength and uniform properties, the hot rolled strips produced by the method according to the invention can be directly further processed more inexpensively by working such as bending, adjusting, rewinding, etc., or rolled out into cold rolled strips. At the same time, the hot rolled strips are outstanding for uniformity of properties and structural formation over their length and width.

TABLE 1

| | | Chemical Analysis of the Steels in % - by weight | | | | | | | | | | | | | |
|---|---|---|---|---|---|---|---|---|---|---|---|---|---|---|---|
| Steel | type | C | Mn | Si | P | S | N | Al | Cr | Ni | Mo | V | Te | Ti | Zr |
| A–C | similar to C 35 | 0.33 | 0.94 | 0.35 | 0.018 | 0.006 | 0.0038 | 0.022 | 0.35 | 0.042 | 0.002 | — | — | — | 0.0 |
| D–I | similar to C 45 | 0.44 | 0.68 | 0.25 | 0.016 | 0.005 | 0.0042 | 0.012 | 1.05 | 0.014 | 0.003 | — | 0.002 | — | — |
| J–L | 50 Cr V4 | 0.53 | 0.92 | 0.34 | 0.010 | 0.008 | 0.0040 | 0.015 | 0.95 | 0.017 | 0.001 | 0.10 | — | — | — |
| M–P | 55 Si 7 | 0.56 | 0.80 | 1.68 | 0.012 | 0.004 | 0.0050 | 0.030 | 0.012 | 0.016 | 0.001 | — | — | — | — |
| Q–V | similar to C 75 | 0.74 | 0.61 | 0.34 | 0.016 | 0.005 | 0.0036 | 0.024 | 0.015 | 0.012 | 0.006 | — | — | — | — |
| X–Z | similar to C 85 | 0.85 | 0.79 | 0.27 | 0.015 | 0.009 | 0.0043 | 0.010 | 0.37 | 0.02 | 0.001 | — | — | 0.02 | — |

TABLE 2

| Steel | | Name of material according to DIN 17200 and 17222 | C % | Rolling end temperature °C. | Coiling temp. °C. | average cooling speed in the transformation rouge (K/s) | Transformation place | $R_{eL}$ N/mm² | $R_m$ N/mm² | $A_{80}$ % | Hardness HRB *HRC | average lameliar distance in μm |
|---|---|---|---|---|---|---|---|---|---|---|---|---|
| A | Invention | C 35 | 0,33 | 900 | 710 | 0.01 | Coil | 250 | 540 | 24,2 | 84 | 0,40 |
| B | Invention | C 35 | 0,33 | 890 | 700 | 0,01 | Coil | 245 | 535 | 24,5 | 84 | 0,40 |
| C | | C 35 | 0,33 | 870 | 585 | 15 | run-out roller table | 512 | 720 | 18,2 | 95 | 0,20 |
| D | Invention | C 45 | 0,44 | 880 | 680 | 0,01 | Coil | 282 | 592 | 22,5 | 87 | 0,35 |
| E | Invention | C 45 | 0,44 | 890 | 700 | 0,01 | Coil | 300 | 632 | 21,0 | 87 | 0,35 |
| F | | C 45 | 0,44 | 850 | 670 | 9 | run-out roller table + Coil | 465 | 765 | 17,5 | 95 | 0,20 |
| G | | C 45 | 0,44 | 840 | 650 | 7 | run-out roller table + Coil | 500 | 780 | 16,2 | 95 | 0,20 |
| H | | C 45 | 0,44 | 900 | 540 | 30 | run-out roller table | 610 | 860 | 16,2 | 99 | 0,15 |
| I | | C 45 | 0,44 | 890 | 600 | 25 | run-out roller table | 615 | 835 | 16,0 | 99 | 0,15 |
| J | Invention | 50CrV4 | 0,53 | 870 | 660 | 0,01 | Coil | 436 | 723 | 12,1 | 94 | 0,35 |
| K | | 50CrV4 | 0,53 | 830 | 670 | 15 | run-out roller table + Coil | 506 | 863 | 11,5 | 99 | 0,20 |
| L | | 50CrV4 | 0,53 | 820 | 620 | 25 | run-out roller table + Coil | 556 | 981 | 10,2 | 25* | 0,16 |
| M | Invention | 55Si7 | 0,56 | 900 | 700 | 0,01 | Coil | 365 | 690 | 15,7 | 93 | 0,30 |
| N | | 55Si7 | 0,56 | 840 | 665 | 20 | run-out roller table + Coil | 704 | 1050 | 13,3 | 26* | 0,12 |
| O | | 55Si7 | 0,56 | 880 | 620 | 25 | run-out roller table | 702 | 1077 | 15,0 | 26* | 0,12 |
| P | | 55Si7 | 0,56 | 830 | 600 | 25 | run-out roller table | 754 | 1120 | 14,5 | 27* | 0,10 |
| Q | Invention | C 75 | 0,74 | 890 | 710 | 0,01 | Coil | 435 | 735 | 15,6 | 94 | 0,30 |
| R | Invention | C 75 | 0,74 | 870 | 665 | 0,01 | Coil | 420 | 715 | 15,4 | 94 | 0,30 |
| S | | C 75 | 0,74 | 860 | 680 | 15 | run-out roller table + Coil | 552 | 880 | 14,0 | 99 | 0,18 |
| T | | C 75 | 0,74 | 830 | 630 | 10 | run-out roller table | 630 | 974 | 13,0 | 25* | 0,15 |
| U | | C 75 | 0,74 | 880 | 600 | 23 | run-out roller table | 720 | 1060 | 11,4 | 26* | 0,12 |
| V | | C 75 | 0,74 | 890 | 580 | 26 | run-out | 770 | 1135 | 11,6 | 28* | 0,10 |
| X | Invention | C 85 | 0,85 | 895 | 650 | 0,01 | Coil | 440 | 745 | 12,5 | 95 | 0,30 |

TABLE 2-continued

| Steel | | Name of material according to DIN 17200 and 17222 | C % | Rolling end temperature °C. | Coiling temp. °C. | average cooling speed in the transformation rouge (K/s) | Transformation place | $R_{eL}$ N/mm² | $R_m$ N/mm² | $A_{80}$ % | Hardness HRB *HRC | average lameliar distance in μm |
|---|---|---|---|---|---|---|---|---|---|---|---|---|
| Y | Invention | C 85 | 0,85 | 880 | 660 | 0,01 | Coil | 395 | 730 | 10,8 | 96 | 0,30 |
| Z | | C 85 | 0,85 | 845 | 600 | 28 | run-out roller table | 898 | 1328 | 9.5 | 32* | 0,08 |

I claim:

1. A method of producing a hot rolled strip having a tensile strength of Rm=500 to 780 N/mm² from an unalloyed or low-alloy steel having 0.3 to 0.9% C, comprising austenizing a steel slab, hot rolling the slab into a hot rolled strip, cooling the strip on a run-out table and winding the strip into a coil, wherein the hot rolling and cooling of the hot rolled strip on the run-out table are controlled such that the austenite/ferrite transformation in the hot rolled strip starts only in the coil and is finished in the coil.

2. A method according to claim 1, wherein the final rolling temperature in hot rolling is 860° C. or higher, a rolling velocity of at least 7 m/sec is adjusted in the last finishing stand, and the coiling temperature is maintained at 640° C. or higher by slight water cooling.

3. A method according to claim 1, wherein the carbon is 0.33 to 0.49% in the hot strip and to attain a maximum tensile strength of 650 N/mm² the final rolling temperature in hot rolling is 860°C. or higher, a rolling velocity of at least 8 m/sec is employed in the last finishing stand, and the coiling temperature is maintained at 680° C. or higher.

4. A method according to claim 1, wherein the carbon content is 0.50 to 0.65% in the hot strip and to attain a maximum tensile strength of 730 N/mm² the final rolling temperature in hot rolling is 860° C. or higher, a rolling velocity of at least 7.5 m/sec is employed in the last finishing stand, and the coiling temperature is maintained at 660° C. or higher.

5. A method according to claim 1, wherein the carbon content is 0.66 to 0.90% in the hot strip and to attain a maximum tensile strength of 780 N/mm² the final rolling temperature in hot rolling is 860° C. or higher, a rolling velocity of at least 7 m/sec is employed in the last finishing stand, and the coiling temperature is maintained at 640° C. or higher.

6. A method according to claim 1, wherein a hot strip is produced from a steel containing 0.32–0.9% C,
0.20–1.5% Mn,
up to 2.0% Si,
up to 0.05% P,
up to 0.05% S,
up to 0.02% N,
up to 0.15% Al, the remainder being iron and unavoidable impurities.

7. A method according to claim 6, wherein the steel is additionally alloyed with one or more of the following:

up to 3.5% Cr,
up to 3.5% Ni,
up to 0.5% Mo,
up to 0.20% V,
up to 0.03% Ti,
up to 0.15% Zr,
up to 0.005% Te,
up to 0.01% B.

8. A method according to claim 1, wherein the cooling speed in the coil is controlled to 0.05 k/s or less.

9. A product produced by the method as set forth in claim 1 and having a yield strength of 250 to 440 N/mm².

* * * * *